US007856725B2

(12) United States Patent
Marut

(10) Patent No.: US 7,856,725 B2
(45) Date of Patent: Dec. 28, 2010

(54) RAZOR WITH ARTICULATED HANDLE EXTENSION

(76) Inventor: Brett C. Marut, 1250 10th St., Suite #1, Santa Monica, CA (US) 90401

( * ) Notice: Subject to any disclaimer, the term of this patent is extended or adjusted under 35 U.S.C. 154(b) by 0 days.

(21) Appl. No.: 11/442,099

(22) Filed: May 26, 2006

(65) Prior Publication Data

US 2007/0062043 A1 Mar. 22, 2007

Related U.S. Application Data

(63) Continuation-in-part of application No. 11/392,243, filed on Mar. 28, 2006, now abandoned.

(60) Provisional application No. 60/719,540, filed on Sep. 21, 2005.

(51) Int. Cl.
*B26B 21/52* (2006.01)

(52) U.S. Cl. ..... 30/527; 30/531

(58) Field of Classification Search ..... 30/526, 30/527, 335, 531
See application file for complete search history.

(56) References Cited

U.S. PATENT DOCUMENTS

| | | | | |
|---|---|---|---|---|
| 4,879,811 | A | 11/1989 | Cooney | |
| 4,955,136 | A | 9/1990 | Diaz-Rivera | |
| 5,010,645 | A | 4/1991 | Furukawa | |
| 5,167,069 | A * | 12/1992 | Quinn | 30/527 |
| 5,193,528 | A * | 3/1993 | Iwamoto et al. | 601/72 |
| 6,163,963 | A * | 12/2000 | Huang | 30/162 |
| 6,189,222 | B1 * | 2/2001 | Doyle | 30/531 |
| 7,103,980 | B2 * | 9/2006 | Leventhal | 30/526 |
| 2003/0208914 | A1 * | 11/2003 | Ehrlich et al. | 30/526 |
| 2004/0107585 | A1 | 6/2004 | Helmrich | |
| 2004/0194325 | A1 * | 10/2004 | Ehrlich et al. | 30/526 |

FOREIGN PATENT DOCUMENTS

| | | |
|---|---|---|
| GB | 148581 | 8/1920 |

* cited by examiner

*Primary Examiner*—Kenneth E. Peterson
*Assistant Examiner*—Sean Michalski
(74) *Attorney, Agent, or Firm*—Raymond Sun

(57) ABSTRACT

A razor assembly has a shaving head and a handle. The handle has a first handle section attached to the shaving head, and a second handle section pivotably coupled to the first handle section, the second handle section having a length that is adjustable. The second handle section is pivoted in a first direction to a first retracted position adjacent the first handle section, and pivoted in a second direction to a second extended position with respect to the first handle section.

4 Claims, 3 Drawing Sheets

RAZOR WITH ARTICULATED HANDLE EXTENSION

RELATED CASES

This is a continuation-in-part of Ser. No. 11/392,243, filed Mar. 28, 2006, now abandoned which is based on Provisional Specification No. 60/719,540, filed Sep. 21, 2005, the entire disclosures of which are incorporated by reference as though set forth fully herein.

BACKGROUND OF THE INVENTION

1. Field of the Invention

The present invention relates to razors, and in particular, to a razor that includes an extendable handle to assist the user in reaching areas of the back that cannot be reached with a normal sized razor.

2. Description of the Prior Art

It is often desirable to be able to shave body hair from one's back, and at the same time it is very difficult to do so. This problem has been considered in the prior art, as exemplified by U.S. Pat. No. 5,010,645, which discloses a foldable razor with an extendable handle. Another aspect for razors includes the ability to alter the angle of the shaving head relative to the handle to facilitate the shaving of different parts of the face and body, as disclosed in U.S. Pat. Nos. 4,955,136 and 4,879,811.

However, none of these prior art attempts disclose a razor that can be easily used to shave one's back.

SUMMARY OF THE INVENTION

It is an object of the present invention to overcome the drawbacks set forth above.

It is another object of the present invention to provide a razor that can be easily used to shave one's back.

In order to accomplish the above-described and other objects of the present invention, the present invention provides a razor assembly that has a shaving head and a handle. The handle has a first handle section attached to the shaving head, and a second handle section pivotably coupled to the first handle section, the second handle section having a length that is adjustable. The second handle section is pivoted in a first direction to a first retracted position adjacent the first handle section, and pivoted in a second direction to a second extended position with respect to the first handle section.

DETAILED DESCRIPTION OF THE PREFERRED EMBODIMENTS

Figure 1A:
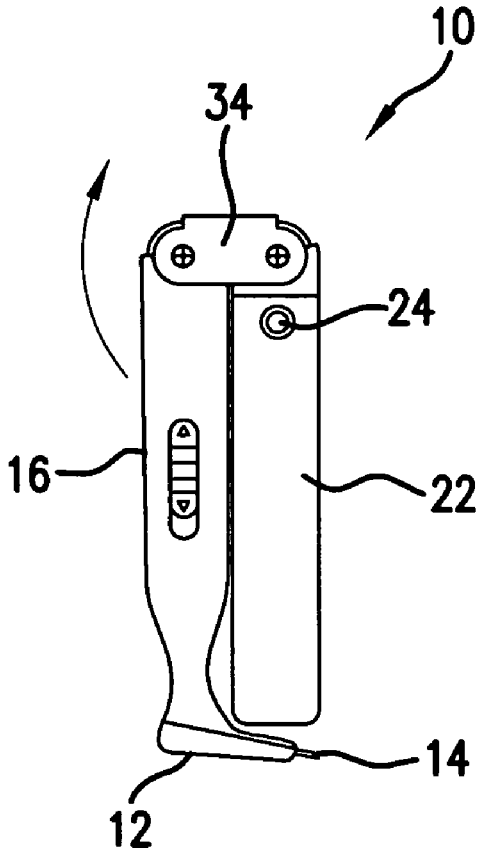
FIG. 1*a* is a side plan view of a razor according to one embodiment of the present invention shown in the folded configuration.
Figure 1B:
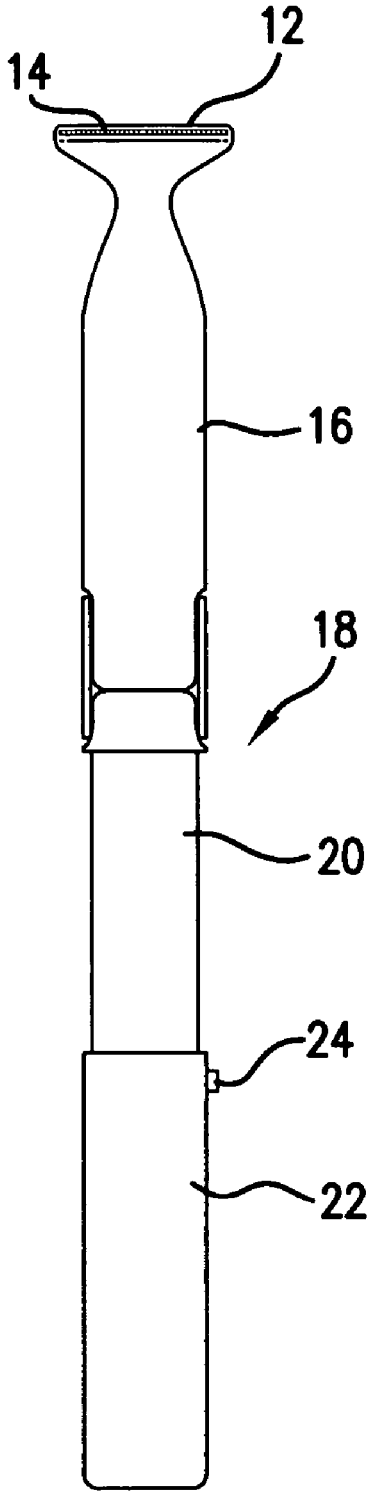
FIG. 1*b* is a front plan view of the razor of FIG. 1*a*.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1*a*-1*e* and 2*a*-2*c* illustrate a razor 10 according to one embodiment of the present invention. The razor 10 includes a head 12, one or more blades 14 removably secured to the head 12, a first handle section 16 connected to the head 12, and a second hinged handle section 18 extending from the first handle section 16. In particular, the top end of the second handle section 18 is pivotably connected to a connector 34 along a pivot axis defined by a pivot pin 28, and the bottom end of the first handle section 16 is pivotably connected to the connector 34 along a pivot axis defined by another pivot pin 36. The second handle section 18 includes a first portion 20 that is hingedly connected to the connector 34, and a second portion 22 that is slidably mounted on the first portion 20 for varying the length of the second handle section 18. The second portion 22 can be retained at a selected one of a plurality of positions along the length of the first portion 20 by a detent button 24 that operates as a locking mechanism, as explained in greater detail below.

The head 12 can be formed as part of the first handle section 16 if the razor 10 is an electric razor, and the head 12 can be pivotably connected to the first handle section 16 if the razor 10 is a manual razor. In addition, the first handle section 16 can optionally include a compartment 26. The compartment 26 can be used to hold extra blades 14 if the razor 10 is a manual razor, or used as a battery compartment if the razor 10 is an electric razor.

Figure 1C:
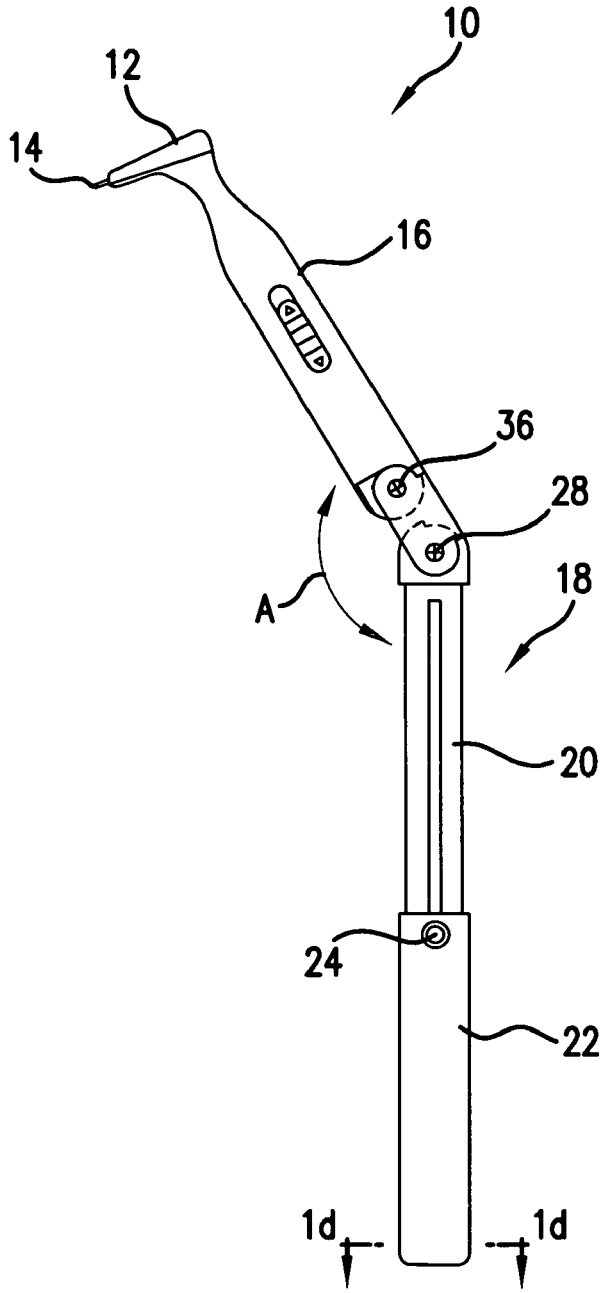
FIG. 1*c* is a side plan view of the razor of FIG. 1*a* shown in the unfolded or fully extended configuration.
Figure 1E:
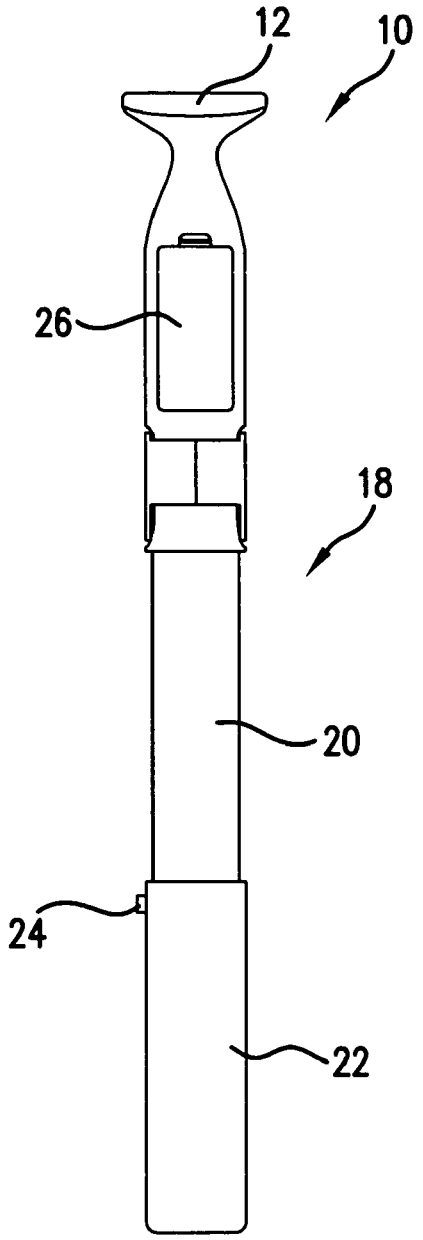
FIG. 1*e* is a rear plan view of the razor of FIG. 1*a*.
Figure 1D:
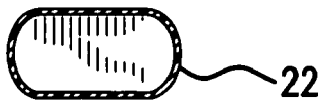
FIG. 1*d* is a bottom plan view of the razor of FIG. 1*a*.
Figure 2A:
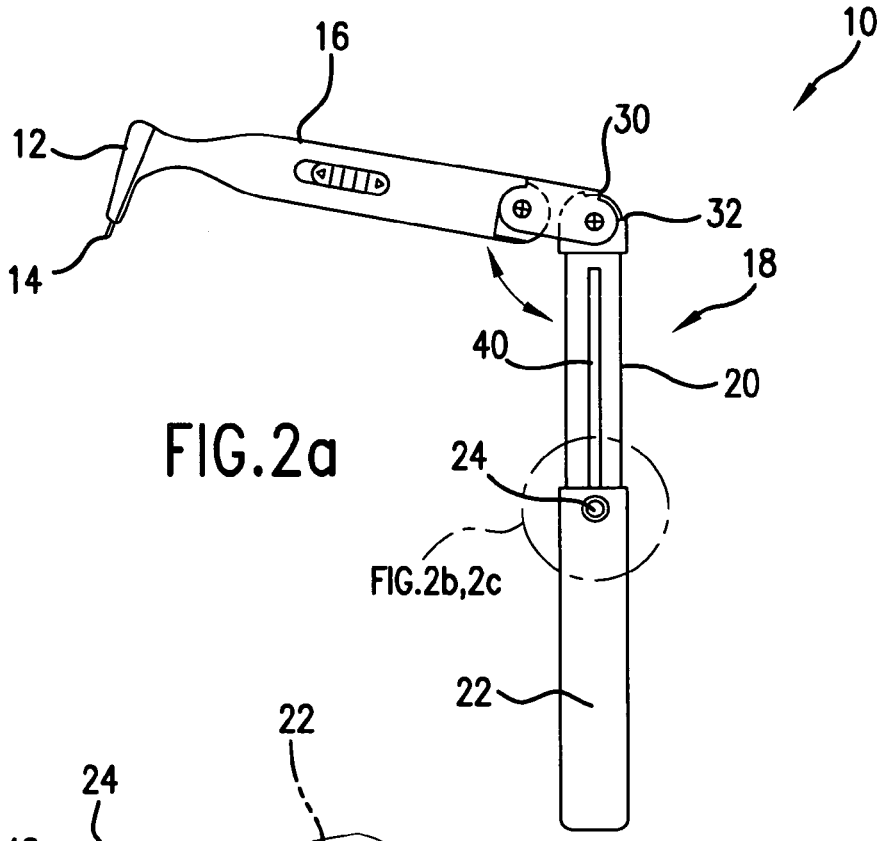
FIG. 2*a* is a side plan view of the razor of FIG. 1*a* shown in the partially folded or partially extended configuration.

In a preferred embodiment of the present invention, the connector 34 and the second handle portion 18 include opposing engageable surfaces 30 and 32, respectively, at the bottom end of the connector 34 and the top end of the second handle portion 18, respectively (see FIG. 2*a*). When the handle portions 16 and 18 are pivoted about the pivot axis defined by the pivot pin 28, the surfaces 30 and 32 abut (see FIG. 1*c*) to prevent further rotation of the first handle portion 16 in the clockwise direction (as viewed from the orientation of FIG. 1*c*), thereby positioning the first handle portion 16 at a maximum angle A relative to the second handle portion 18. Referring to FIG. 1*c*, the angle A can be about 135 degrees to 150 degrees, which the inventor believes to be ideal for enabling a user to reach and effectively place the shaving head 12 and the blade 14 on the hard-to-reach areas of the back. This range of angles allows the user to place the head 12 against the skin on the back without unusual or uncomfortable contortions of the user's wrist or arm. Although the present invention describes the use of 135-150 degrees for the angle A, angle A can be any angle between 90 degrees and 180 degrees, depending upon the related variables, such as the body type or height of the user, the shaving locations on the back, etc.

As best shown in FIG. 1*a*, the first handle portion 16 can be pivoted about the pivot axis defined by the pivot pin 36, and the first handle portion 16 can be further pivoted about the pivot axis defined by the pivot pin 28, to align the handle portions 16 and 18 side-by-side in parallel with each other to obtain a compact configuration that allows the razor 10 to be conveniently packed or stored.

Figure 2B:
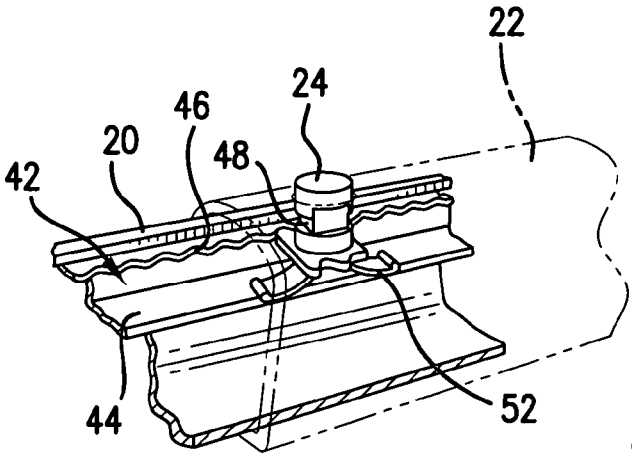
FIG. 2*b* is a sectional perspective view of a portion of the extendable handle of the razor of FIG. 1*a* showing the locking mechanism.
Figure 2C:
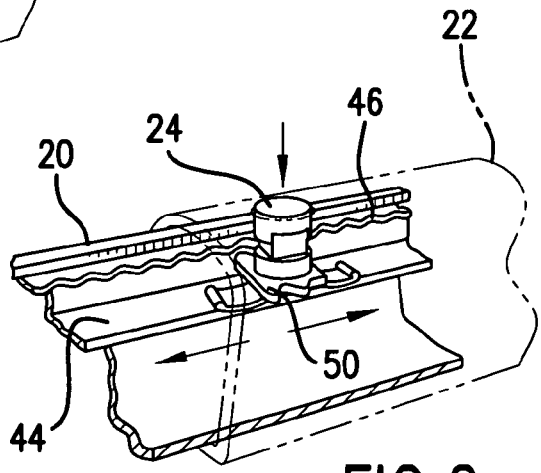
FIG. 2*c* is a sectional perspective view of a portion of the extendable handle of the razor of FIG. 1*a* showing the locking mechanism being actuated.

Referring to FIGS. 2*a*, 2*b* and 2*c*, the first portion 20 of the second handle section 18 has an elongated slit 40 that leads into a channel 42 inside the first portion 20. The channel 42 has a wall 44 that extends along the length of the channel 42. The slit 40 has wavy edges that define notches 46, with opposing notches 46 defining an opening. The detent button 24 has a generally circular body with a groove 48 extending around the body. The button 24 extends through an opening in the second portion 22 (see FIG. 2*b*) and then through the slit 40, and rests on top of a plate 50, with an elastic member 52 (e.g., a spring plate) seated inside the channel 42 against the wall 44. The plate 50 is normally biased by the elastic member 52 against the wall of the wavy edges to prevent the button 24 from being ejected from the slit 40. The diameter of the body of the button 24 is sized to fit snugly inside the opening of an opposing pair of notches 46 in the slit 40, so that the button 24 is adapted to be secured inside any of the selected openings. The button 24 has a reduced diameter at the groove 48, so that the button 24 can be moved along the slit 40 when the button 24 is depressed against the bias of the elastic member 52 to the level where the wavy edges of the slit 40 are received in, and travel along, the groove 48. When the button 24 is not depressed, the natural bias of the elastic member 52 will push the button 24 back through the slit 40 so that the body of the button 24 is received and secured in the selected opening of an opposing pair of notches 46.

Thus, the user can adjust the length of the second handle section 18 by pressing on the button 24 to the level where the wavy edges of the slit 40 are received in the groove 48. The user then moves the button 24 (and the second portion 22 carried by the button 24) along the slit 40 until the combined length of the portions 20 and 22 are at the desired length. The user then releases his pressing force on the button 24, so that the natural bias of the elastic member 52 will then push the button 24 back through the slit 40 so that the body of the button 24 is received and secured in the selected opening of an opposing pair of notches 46. When the user wishes to adjust the length of the second handle section 18 again, the user presses the button 24 and repeats the steps set forth above. As part of the adjustment, the user can even insert the entire length of the first portion 20 inside the hollow interior of the second portion 22, as shown in FIG. 1*a*, to facilitate folding and storage of the razor 10.

The razor 10 can be manufactured from any material, and non-limiting examples include metals, polymeric materials, or the like. For example, the first and second handle sections 16 and 18 can be formed of a thermoplastic material.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A razor assembly, comprising:

a shaving head;

a handle having:

a connector having a first engageable surface, and two parallel side plates;

a first handle section connected to the shaving head;

a second handle section pivotably coupled to the first handle section by the connector, the second handle section having:

a second engageable surface, a first portion and a second portion, with the first portion being slidable with respect to the second portion to adjust the length of the second handle section, and a detent assembly for locking the first portion at a fixed location along the second portion, the detent assembly including a button resting on a plate, with an elastic member coupled between and contacting the plate and the first portion and biasing the button through the first portion, the button being movable longitudinally along the first portion;

wherein the second handle section is pivoted in a first direction to a first retracted position side-by-side the first handle section, and pivoted in a second direction to a second extended position with respect to the first handle section, wherein the first and second engageable surfaces engage each other to limit the pivoting of the handle sections with respect to each other at the second extended position to an angle of no more than 135 degrees; and wherein each of the first and second handle sections has an outer surface, and two recessed surfaces adjacent the location where each handle section is pivotably coupled to the side plates, and the recessed surfaces accept the side plates in a manner to provide two flush parallel surfaces extending across the side plates to the outer surfaces of the first and second handle sections.

2. The assembly of claim 1, wherein the first portion has a longitidunal slit provided thereon, with the button being movable along the slit.

3. The assembly of claim 2, wherein the slit has a plurality of notches.

4. The assembly of claim 3, wherein the plate and the elastic member are coupled to the button in a manner such as to be movable together with the button.

* * * * *